US012760469B2

(12) United States Patent
Schnelle et al.

(10) Patent No.: US 12,760,469 B2
(45) Date of Patent: Oct. 13, 2026

(54) METHOD FOR DIGESTING LIGNOCELLULOSIC MATERIAL

(71) Applicant: SOLENIS TECHNOLOGIES, L.P., Wilmington, DE (US)

(72) Inventors: Scott Thomas Schnelle, West Grove, PA (US); Daniel Joseph Nicholson, Swarthmore, PA (US); Erin A.S. Doherty, Hockessin, DE (US)

(73) Assignee: SOLENIS TECHNOLOGIES, L.P., Wilmington, DE (US)

( * ) Notice: Subject to any disclaimer, the term of this patent is extended or adjusted under 35 U.S.C. 154(b) by 124 days.

(21) Appl. No.: 18/520,639

(22) Filed: Nov. 28, 2023

(65) Prior Publication Data

US 2024/0175205 A1 May 30, 2024

Related U.S. Application Data

(60) Provisional application No. 63/385,223, filed on Nov. 29, 2022.

(51) Int. Cl.

| | |
|---|---|
| ***D21C 3/02*** | (2006.01) |
| ***D21C 3/00*** | (2006.01) |
| ***D21C 3/22*** | (2006.01) |
| ***D21C 3/28*** | (2006.01) |

(52) U.S. Cl.

CPC ..... *D21C 3/022* (2013.01); *D21C 3/003* (2013.01); *D21C 3/006* (2013.01); *D21C 3/222* (2013.01); *D21C 3/28* (2013.01)

(58) Field of Classification Search

CPC ..... D21C 3/02; D21C 3/022; D21C 3/003; D21C 3/006; D21C 3/222; D21C 3/28

See application file for complete search history.

(56) References Cited

U.S. PATENT DOCUMENTS

| | | | | |
|---|---|---|---|---|
| 5,032,224 | A | 7/1991 | Ahluwalia | |
| 6,770,168 | B1 * | 8/2004 | Stigsson | D21C 3/222 162/76 |
| 2007/0215300 | A1 | 9/2007 | Upfal et al. | |
| 2008/0277083 | A1 * | 11/2008 | Shevchenko | D21C 9/008 162/49 |

FOREIGN PATENT DOCUMENTS

| | | | | |
|---|---|---|---|---|
| CN | 110512452 | B | 9/2021 | |
| EP | 0006201 | B1 | 1/1980 | |
| WO | WO-2006128836 | A2 * | 12/2006 | A01N 25/30 |
| WO | WO-2008076055 | A1 * | 6/2008 | D21C 3/22 |

* cited by examiner

*Primary Examiner* — Anthony Calandra

(74) *Attorney, Agent, or Firm* — Ingrassia Fisher & Lorenz LLP

(57) ABSTRACT

A method for digesting lignocellulosic material includes combining a lignocellulosic material comprising lignocellulosic biomass, a polymerized naphthalene sulfonate, a sodium xylene sulfonate, and a white liquor comprising sodium hydroxide and sodium sulfide to form a mixture. Further, the method includes heating the mixture to digest at least a portion of the lignocellulosic material.

20 Claims, 2 Drawing Sheets

METHOD FOR DIGESTING LIGNOCELLULOSIC MATERIAL

CROSS-REFERENCE TO RELATED APPLICATION

This application claims the benefit of U.S. Provisional Application No. 63/385,223, filed Nov. 29, 2022, which is hereby incorporated in its entirety by reference.

TECHNICAL FIELD

Embodiments described herein relate to compositions and methods for digesting lignocellulosic material, such as in a Kraft pulping process. More specifically, this disclosure relates to the combination of a polymerized naphthalene sulfonate and a sodium xylene sulfonate to synergistically provide increased digestion efficiency as compared to a process that does not utilize the combination of the polymerized naphthalene sulfonate and the sodium xylene sulfonate.

BACKGROUND

The Kraft pulping process is one of the major pulping processes in the pulp and paper industry. The process utilizes sodium hydroxide and sodium sulfide added to a medium that is used to cook wood chips and produce pulp. When this technique was introduced over a century ago, the addition of sodium sulfide produced a dramatic improvement in pulp strength, pulp yield, and durability of the paper made therefrom.

In the typical Kraft digestion process, wood chips are added to an aqueous medium including mostly white liquor which becomes dark colored "black liquor" as lignin and wood components are solubilized and dissolved over the course of the cook. Typical white liquor includes a solution of sodium hydroxide, sodium carbonate, sodium sulfate, sodium sulfide and various other inorganic materials. White liquor solubilizes wood components and removes much of the lignin from the chips, resulting in liberated fibers or "pulp" in a solution of "black liquor". In practice, the liquor in which the wood chips are cooked, or cooking liquor, includes a mixture of black liquor and white liquor. Specifically, black liquor may be recycled back to the cooking vessel, or digester, from a prior batch of wood chips, while the white liquor is a freshly prepared alkaline solution. The composition of the black liquor may vary considerably among different mills depending on the white liquor, the type of wood, and the method of cooking.

Ideally, all of the wood chips are cooked uniformly during the digestion process. However, in practice, not all in the fibers in the chips will be separated. Any unseparated fiber bundles will be classified as "rejects'. When the quantity of rejects screened out during this pulping process increases, a lowered yield (defined as dry weight of pulp produced per unit dry weight of wood consumed) results.

Lignin, in addition to cellulose and hemicellulose, is one of the main constituents of wood. Lignin is a natural, highly aromatic and hydrophobic polymer. For the production of bleaching grade pulp, most of the lignin gets disintegrated and removed from cellulose by Kraft pulping, and additional amounts of lignin are further reduced by a series of bleaching and extraction stages. There is a continuing need for improvement in lignin removal, cooking and bleaching chemical savings, and reduced cooking time.

During the digestion process, various additives can be employed for providing a pulp and/or resulting paper product with desirable characteristics and properties. Additionally, various additives can also be employed to control or enhance the digestion process. For instance, additives can be employed to improve the pulp yield and/or to reduce the number of extractives. Although various agents and processes have been employed to enhance the cooking of wood pulp, many compositions and methods are deficient in producing a reduction in pulp rejects and an increased pulp yield.

As a result, while current compositions and methods exist, it is desirable to provide a composition and method for improving the performance of a Kraft pulping process. Further, it is desirable to provide a composition and method for increasing digester efficiency. More specifically, the pulping industry is in need of a more effective digester additive combination to replace anthraquinone which was commonly used but has recently been abandoned by most of the pulp manufacturing community due to concerns over potential toxicity. Other desirable features and characteristics of the present disclosure will become apparent from the subsequent detailed description and the appended claims, taken in conjunction with the accompanying drawings and this background.

BRIEF SUMMARY

This disclosure provides a method for digesting lignocellulosic material. The method includes combining a lignocellulosic material comprising lignocellulosic biomass, a polymerized naphthalene sulfonate, a sodium xylene sulfonate, and a white liquor comprising sodium hydroxide and sodium sulfide to form a mixture. Further, the method includes heating the mixture to digest at least a portion of the lignocellulosic material.

In exemplary embodiments of the method, the lignocellulosic material is present in an amount of from 10 to 30 weight percent based on a total weight of the mixture.

In exemplary embodiments of the method, a weight ratio of polymerized naphthalene sulfonate to sodium xylene sulfonate is from 10:90 to 90:10.

In exemplary embodiments of the method, a weight ratio of polymerized naphthalene sulfonate to sodium xylene sulfonate is from 40:60 to 60:40.

In exemplary embodiments of the method, a combination of the polymerized naphthalene sulfonate and the sodium xylene sulfonate is present in an amount of from 0.1 to 10 kg per metric ton of dry lignocellulosic material.

In exemplary embodiments of the method, the white liquor is present in an amount of from 70 to 90 weight percent based on a total weight of the mixture.

In exemplary embodiments of the method, the mixture is free of added surfactants that are not the polymerized naphthalene sulfonate and/or the sodium xylene sulfonate.

In exemplary embodiments of the method, the method has an increased digestion efficiency as compared to a process that does not utilize a combination of the polymerized naphthalene sulfonate and the sodium xylene sulfonate.

In exemplary embodiments of the method, heating the mixture includes heating the mixture to a temperature of from 125° C. to 185° C.

In exemplary embodiments of the method, the lignocellulosic material is present in an amount of from 10 to 30 weight percent based on a total weight of the mixture; a weight ratio of polymerized naphthalene sulfonate to sodium xylene sulfonate is from 10:90 to 90:10; a combination of the polymerized naphthalene sulfonate and the sodium xylene sulfonate is present in an amount of from 0.1 to 10 kg per metric ton of dry lignocellulosic material; the white liquor is present in an amount of from 70 to 90 weight percent based on a total weight of the mixture; the mixture is free of added surfactants that are not the polymerized naphthalene sulfonate and/or the sodium xylene sulfonate; and the method has an increased digestion efficiency as compared to a method that does not utilize a combination of the polymerized naphthalene sulfonate and the sodium xylene sulfonate.

In exemplary embodiments of the method, the mixture consists essentially of the lignocellulosic material, the polymerized naphthalene sulfonate, the sodium xylene sulfonate, the white liquor, and a recycled aqueous stream from a pulping process.

In another embodiment, a method for digesting lignocellulosic material includes combining a lignocellulosic material comprising lignocellulosic biomass, a dispersant, a penetrant, and a white liquor comprising sodium hydroxide and sodium sulfide to form a mixture; and heating the mixture to digest at least a portion of the lignocellulosic material. In the method, the mixture has a dispersant to penetrant ratio of from 10:90 to 90:10, and the mixture has a combined total content of the dispersant and the penetrant of from 0.1 to 10 kg per metric ton of dry lignocellulosic material.

In exemplary embodiments of the method, the mixture has a dispersant to penetrant ratio of from 40:60 to 60:40.

In exemplary embodiments of the method, the dispersant comprises polymerized naphthalene sulfonate and the penetrant comprises sodium xylene sulfonate.

In exemplary embodiments of the method, the dispersant consists of polymerized naphthalene sulfonate and the penetrant consists of sodium xylene sulfonate.

In another embodiment, a mixture is provided and includes lignocellulosic material comprising lignocellulosic biomass present in an amount of from 10 to 30 weight percent based on a total weight of the mixture, white liquor comprising sodium hydroxide and sodium sulfide and present in an amount of from 70 to 90 weight percent based on a total weight of the mixture; a dispersant; and a penetrant. In exemplary embodiments, the dispersant and the penetrant are present in the mixture in a weight ratio of actives from 10:90 to 90:10, respectively, and a combination of the dispersant and the penetrant is present in an amount of from 0.1 to 10 kg actives/metric ton dry lignocellulosic material.

In exemplary embodiments, the mixture is free of added surfactants that are not the dispersant and/or the penetrant.

In exemplary embodiments of the mixture, the dispersant consists of polymerized naphthalene sulfonate and the penetrant consists of sodium xylene sulfonate.

In exemplary embodiments of the mixture, the mixture consists essentially of the lignocellulosic material, the polymerized naphthalene sulfonate, the sodium xylene sulfonate, the white liquor, and a recycled aqueous stream from a pulping process.

In exemplary embodiments of the mixture, the mixture consists essentially of the lignocellulosic material, the dispersant, the penetrant, the white liquor, and a recycled aqueous stream from a pulping process.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

The present disclosure will hereinafter be described in conjunction with the following drawing figures, wherein like numerals denote like elements.

DETAILED DESCRIPTION

Figure 1:
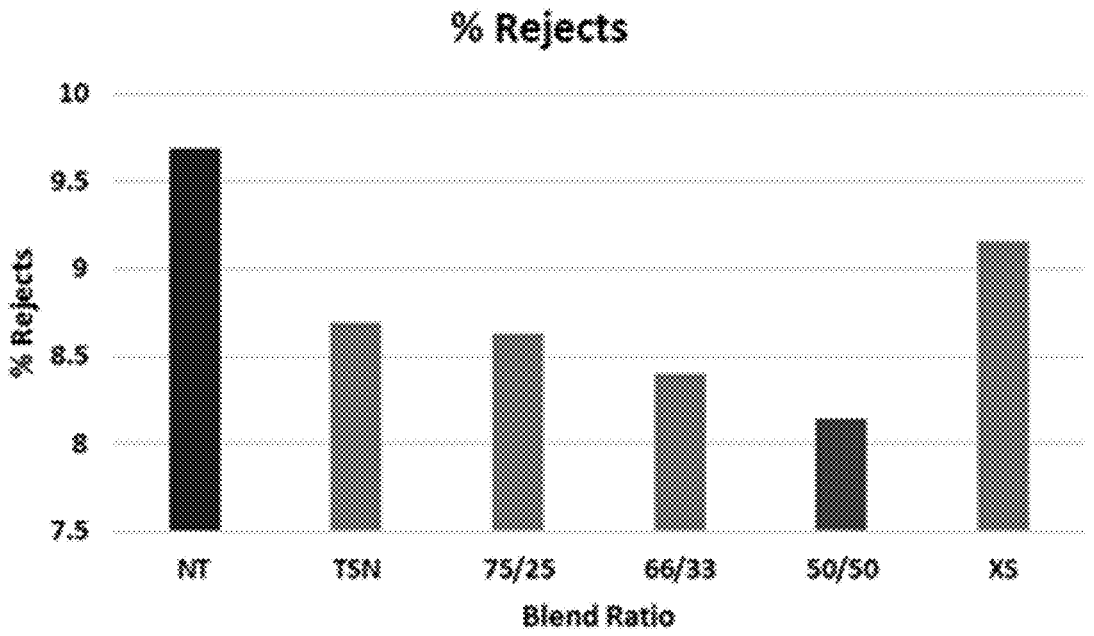
FIG. 1 is a bar-graph showing the percentage of rejected fiber bundles resulting from treatment of lignocellulosic material according to exemplary methods herein and according to comparative methods.

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

As used herein, "a," "an," or "the" means one or more unless otherwise specified. The term "or" can be conjunctive or disjunctive. Open terms such as "include," "including," "contain," "containing" and the like mean "comprising." In this disclosure, the terminology "about" can describe values±0.1, 0.5, 1, 2, 3, 4, 5, 6, 7, 8, 9, or 10%, in various embodiments. Moreover, it is contemplated that, in various non-limiting embodiments, all values set forth herein may be alternatively described as approximate or "about."

Embodiments of the present disclosure are generally directed to lignocellulosic mixtures and methods for digesting the same. For the sake of brevity, conventional techniques related to development and treatment of lignocellulosic materials may not be described in detail herein. Moreover, the various tasks and process steps described herein may be incorporated into a more comprehensive procedure or process having additional steps or functionality not described in detail herein. In particular, various steps in the treatment of lignocellulosic materials are well-known and so, in the interest of brevity, many conventional steps will only be mentioned briefly herein or will be omitted entirely without providing the well-known process details.

This disclosure provides a method for digesting lignocellulosic material, such as for increasing digestion efficiency of lignocellulosic material. In exemplary embodiments, the method comprises, consists essentially of, or consists of: combining a lignocellulosic material comprising lignocellulosic biomass, a polymerized naphthalene sulfonate, a sodium xylene sulfonate, and a white liquor comprising sodium hydroxide and sodium sulfide to form a mixture; and heating the mixture to digest at least a portion of the lignocellulosic material; wherein the lignocellulosic material is present in an amount of from 10 to 30 weight percent based on a total weight of the mixture; a weight ratio of polymerized naphthalene sulfonate to sodium xylene sulfonate is from 10:90 to 90:10; a combination of the polymerized naphthalene sulfonate and the sodium xylene sulfonate is present in an amount of from 0.1 to 10 kg per metric ton of dry lignocellulosic material; the white liquor is present in an amount of from 70 to 90 weight percent based on a total weight of the mixture; the mixture is free of added surfactants that are not the polymerized naphthalene sulfonate and/or the sodium xylene sulfonate; and/or the method has an increased digestion efficiency as compared to a method that does not utilize a combination of the polymerized naphthalene sulfonate and the sodium xylene sulfonate.

This disclosure also provides another method for digesting lignocellulosic material, such as for increasing digestion efficiency of lignocellulosic material. In exemplary embodiments, the method comprises, consists essentially of, or consists of: combining a lignocellulosic material comprising lignocellulosic biomass, a dispersant, a penetrant, and a white liquor comprising sodium hydroxide and sodium sulfide to form a mixture; and heating the mixture to digest at least a portion of the lignocellulosic material; wherein the lignocellulosic material is present in an amount of from 10 to 30 weight percent based on a total weight of the mixture; a weight ratio of dispersant to penetrant is from 10:90 to 90:10; a combination of the dispersant and penetrant is present in an amount of from 0.1 to 10 kg per metric ton of dry lignocellulosic material; the white liquor is present in an amount of from 70 to 90 weight percent based on a total weight of the mixture; the mixture is free of added surfactants that are not the dispersant and/or penetrant; the method has an increased digestion efficiency as compared to a method that does not utilize a combination of the dispersant and penetrant; the dispersant comprises polymerized naphthalene sulfonate; the penetrant comprises sodium xylene sulfonate; the dispersant consists essentially of polymerized naphthalene sulfonate; the penetrant consists essentially of sodium xylene sulfonate; the dispersant consists of polymerized naphthalene sulfonate; and/or the penetrant consists of sodium xylene sulfonate.

This disclosure also provides a mixture comprising, consisting essentially of, or consisting of: lignocellulosic material comprising lignocellulosic biomass present in an amount of from 10 to 30 weight percent based on a total weight of the mixture; white liquor comprising sodium hydroxide and sodium sulfide and present in an amount of from 70 to 90 weight percent based on a total weight of the mixture; a dispersant; and a penetrant, wherein: the dispersant and the penetrant are present in the mixture in a weight ratio of actives from 10:90 to 90:10, respectively; a combination of the dispersant and the penetrant is present in an amount of from 0.1 to 10 kg actives/metric ton dry lignocellulosic material; the mixture is free of added surfactants that are not the dispersant and/or penetrant; the dispersant comprises polymerized naphthalene sulfonate; the penetrant comprises sodium xylene sulfonate; the dispersant consists essentially of polymerized naphthalene sulfonate; the penetrant consists essentially of sodium xylene sulfonate; the dispersant consists of polymerized naphthalene sulfonate; and/or the penetrant consists of sodium xylene sulfonate.

Exemplary embodiments of a method include combining the lignocellulosic material, the polymerized naphthalene sulfonate, the sodium xylene sulfonate, and the white liquor to form a mixture or, alternatively, to form a combination or pulp composition. It is contemplated that the mixture of this disclosure may be alternatively described as a combination or pulp composition.

Typically, the mixture is charged to a treatment vessel, such as a digester, and cooked for a predetermined time with a cooking liquor, such as a white liquor described herein. The treatment vessel, such as the digester, is not particularly limited and may be any known in the art. The mixture may be formed in the treatment vessel, apart from the treatment vessel and then added to the treatment vessel, or both in the treatment vessel and apart from the treatment vessel.

The polymerized naphthalene sulfonate, the sodium xylene sulfonate, and the white liquor may be delivered or transported to contact the lignocellulosic material and form the mixture using any method known in the art. For instance, the one or more components may be added directly to the treatment vessel, such as the digester. Alternatively, one or more components may be added to an input supply stream, such as one for a cooking liquor and then transported to contact the lignocellulosic material. Illustratively, in a batch type digester, the lignocellulosic material and a mixture of recycled "black liquor", i.e., the spent liquor from a previous digester cook that is recycled—such as for use as a diluent, and white liquor and various inorganic materials are pumped into the digester. In the cooking process, lignin, which binds the lignocellulosic material together, is dissolved in the white liquor, forming pulp and black liquor. Other suitable additives can be added to the white liquor as well.

Methods and mixtures herein may provide for a reduction in the amount of white liquor required to achieve a desired digestion efficiency as compared to processes or mixtures that do not include the combination of dispersant and penetrant described herein. For instance, the white liquor required may be reduced by from 0.1% or more, such as 0.5% or more, such as 1% or more, such as 1.5% or more, such as 2% or more, such as 2.5% or more, such as 3% or more, such as 3.5% or more, such as 5% or more, to 15% or less, such as 10% or less, such as 7% or less, such as 5% or less, such as 4% or less, such as 3% or less.

Methods and mixtures herein may provide for a reduction in the amount of sodium hydroxide required to achieve a desired digestion efficiency as compared to processes or mixtures that do not include the combination of dispersant and penetrant described herein. For instance, the sodium hydroxide required may be reduced by from 0.1% or more, such as 0.5% or more, such as 1% or more, such as 1.5% or more, such as 2% or more, such as 2.5% or more, such as 3% or more, such as 3.5% or more, such as 5% or more, to 15% or less, such as 10% or less, such as 7% or less, such as 5% or less, such as 4% or less, such as 3% or less.

Methods and mixtures herein may provide for a reduction in the amount of sodium sulfide required to achieve a desired digestion efficiency as compared to processes or mixtures that do not include the combination of dispersant and penetrant described herein. For instance, the sodium sulfide required may be reduced by from 0.1% or more, such as 0.5% or more, such as 1% or more, such as 1.5% or more, such as 2% or more, such as 2.5% or more, such as 3% or more, such as 3.5% or more, such as 5% or more, to 15% or less, such as 10% or less, such as 7% or less, such as 5% or less, such as 4% or less, such as 3% or less.

Typically, after the mixture is present in a treatment vessel, the treatment vessel is sealed and heated to a suitable cook temperature under high pressure to at least partially digest the lignocellulosic material and form a pulp. For example, in various embodiments, the method further includes the step of heating the mixture in the treatment vessel to a temperature of from 125 to 185° C. to digest at least a portion of the lignocellulosic material. In various embodiments, the temperature is at least 125° C., at least 130° C., at least 135° C., at least 140° C., at least 145° C., at least 150° C., at least 155° C., at least 160° C., at least 165° C., at least 170° C., at least 175° C., or at least 180° C. In various embodiments, the temperature is no greater than 185° C., no greater than 180° C., no greater than 175° C., no greater than 170° C., no greater than 165° C., no greater than 160° C., no greater than 155° C., no greater than 150° C., no greater than 145° C., no greater than 140° C., no greater than 135° C., or no greater than 130° C. In other non-limiting embodiments, it is contemplated that the temperature may be greater or less than the aforementioned ranges so long as the temperature would be recognized by one of skill in the art as sufficient for digesting at least a portion of the lignocellulosic material.

In various embodiments, the lignocellulosic material is subjected to alkaline reagents at elevated temperatures and pressures in a treatment vessel, such as the digester, to produce the pulp. In some embodiments, the temperature is from about 93° C. (200° F.) to about 260° C. (500° F.), such as from about 121° C. (250° F.) to about 177° C. (350° F.), and the pressure is from 60 psi/g to 130 psi/g. Digestion time may be from 30 minutes to 10 hours, depending on the process conditions and the desired pulp/paper characteristics. In various non-limiting embodiments, all values and ranges of value, both whole and fractional, between and including the aforementioned values, are hereby expressly contemplated for use herein.

Reaction conditions present during a cook, or digestion, cause lignin, which is an amorphous polymeric binder found in wood biomass, to be hydrolyzed. Ideally, the lignocellulosic material is digested only long enough to dissolve sufficient lignin to free the fibers, to minimize overcooking and reduction of yield. The pulping process typically attempts to maximize pulp yield, which is defined as the dry weight of pulp produced per unit dry weight of wood consumed.

After cooking, the lignocellulosic material may be blown from the treatment vessel into a blow tank and is typically broken down into separate lignocellulosic fibers. In other words, the fibers originally present in the lignocellulosic material are typically broken apart from one another and separated. In practice, however, some of the fibers fail to separate due, in part, to undissolved lignin remaining in the pulp. These unseparated fibers are typically removed by passing the pulp through a screen having openings of a predetermined size. In the pulping industry, the standard test screen employed is flat with 0.01 inch slots therethrough.

The materials that cannot pass through the screen and are separated by this screening process are known as "rejects". The rejects include fibers that could be used to produce paper. Accordingly, it is highly desirable to decrease the amount of rejects. Methods for lowering the amount of rejects include increasing the digestion time or creating more severe hydrolysis conditions. Such conditions, however, increase the costs involved and cause some of the cellulose to be hydrolyzed and rendered unusable. As described herein, the instant disclosure surprisingly and unexpectedly reduces the amount of rejects that are present without increasing the digestion time or creating more severe hydrolysis conditions.

As is known in the art, a Kappa number corresponds directly to the amount of lignin remaining in the pulp. Generally, the higher the Kappa number, the more lignin is present in the pulp. The Kappa number generally decreases as the digestion time is increased or the alkalinity of the cooking liquor is increased. Typically, the Kappa number is determined using TAPPI STANDARD T236 (Kappa Number of Pulp). As described herein, the instant disclosure surprisingly and unexpectedly reduces the Kappa number without increasing the digestion time or creating more severe hydrolysis conditions.

Cooking or digestion may be terminated when the amount of rejects in the pulp is reduced to an acceptable level. Substantial yield is achieved if the lignocellulosic material is cooked to remove an acceptable lignin content while maintaining an acceptable rejects level.

The efficiency of a cook or digestion process may also be evaluated by determining the amount of residual alkali remaining in the black liquor after the process is completed. When comparing processes having same process conditions with different mixtures and having the same digestion efficiency, a higher amount of residual alkali indicates a more efficient de-lignification process. Specifically, a higher amount of residual alkali illustrates that less alkali was used to obtain the same results. Yield may be obtained when using a same amount of alkali as a result of improved penetration into the lignocellulosic material. For example, when the mixture is able to penetrate into the lignocellulosic material quickly, then the alkali may be uniformly introduced throughout the biomass matrix and contact the lignin for a longer amount of the process duration. In processes in which penetration into the biomass is slower or is incomplete, the contact between the alkali and the lignin occurs for less time despite the process duration. As described herein, the instant disclosure surprisingly and unexpectedly increases the residual alkali without increasing the digestion time or creating more severe hydrolysis conditions.

Lignocellulosic Material:

In exemplary embodiments, the lignocellulosic material includes biomass. The biomass is not limited in its use and can include annual plants and agricultural residues, woody perennials, forestry residues, and trees.

In various embodiments, the lignocellulosic material/biomass may be wood or wood chips. For example, the wood may be any wood known in the art that is employed in a pulping process. For instance, the wood may include hardwoods, softwoods, or mixtures thereof. In one embodiment, the wood may include primarily coniferous wood (e.g., spruce, fir, pine, etc.) or primarily deciduous wood (e.g., *eucalyptus*, poplar, maple, etc.) Typically, the terminology "lignocellulosic material" and/or "biomass" differs from "pulp" herein because pulp refers to at least partially digested lignocellulosic material/biomass.

Dispersant

A dispersant is a substance that improves the separation of colloidal particles suspended in solution to prevent agglomeration and deposition. In embodiments herein, the colloidal particles may be organic wood degradation components or inorganic crystalline salts, or mixtures thereof. It is envisioned that this formulation may prevent particles from agglomeration and settling with the dispersant.

In exemplary embodiments, the dispersant is an anionic surfactant or strongly anionic surfactant. An exemplary anionic surfactant includes a carboxylate, a sulfonate, a phosphate, a polyphosphate, a polymerized alkylarylsulfonate, and a polymerized naphthalene. A polymerized naphthalene/formaldehyde polycondensate or the like may be used, and a sulfonate may be used. In exemplary embodiments, the dispersant is a dispersant polymer.

In certain embodiments, the dispersant is an anionic sulfate or sulfonate dispersant. In exemplary embodiments, the anionic dispersant is an anionic sulfonate dispersant. In certain embodiments, the anionic dispersant is a sulfated/sulfonated polyaromatic compound. In certain embodiments, the anionic dispersant is sodium lignosulfonate.

In an exemplary embodiment, the anionic dispersant is a condensation polymer, such as a naphthalene sulfonate condensation polymer. Generally, condensation polymers may be graded by higher or lower degree of condensation and by content of more or less residual dissolved salts. In exemplary embodiments, the anionic dispersant is a low degree of condensation polymer.

A suitable anionic dispersant includes condensation products of aromatic sulfonic acids with formaldehyde, such as condensation products of formaldehyde and alkylnaphthalenesulfonic acids or of formaldehyde, naphthalenesulfonic acids, and/or benzenesulfonic acids, and condensation products of optionally substituted phenol with formaldehyde and sodium bisulfite. Dispersants from the group consisting of sulfosuccinic acid esters and alkylbenzenesulfonates are also suitable. Ligninsulfonates, for example, those which are obtained by the sulfite or Kraft process, may be suitable. Such compounds may be products that are partly hydrolyzed, oxidized, propoxylated, sulfonated, sulfomethylated, or desulfonated and fractionated by known processes, for example, according to molecular weight or according to the degree of sulfonation.

An exemplary anionic dispersant may be selected from formaldehyde condensation products of alkyl naphthalene sulfonates, formaldehyde condensation products of beta-naphthalene sulfonate, polymerized formaldehyde naphthalene sodium sulfonate, and the like.

An exemplary anionic dispersant is formaldehyde/sodium naphthalene sulfonate condensation product.

In an exemplary embodiment, the anionic dispersant is a low molecular weight condensation product. For example, the anionic dispersant may have a molecular weight of less than 20,000 g/mole; such as less than 10,000 g/mole; less than 8,000 g/mole; less than 7,000 g/mole; or about 6,500 g/mole. The molecular weight can be used as an indication of the degree of condensation for these polymer types.

An exemplary anionic dispersant is a naphthalenesulfonic acid condensation product, such as is commercially available as TAMOL SN from BASF Corporation.

In certain embodiments, the treatment composition may include a single dispersant. In other embodiments, the anionic dispersant may include a combination of more than one dispersant.

In an exemplary embodiment, the active composition, comprising the dispersant and the penetrant, includes at least 1% of the dispersant, such as at least 2%, at least 3%, at least 4%, at least 5%, at least 6%, at least 7%, at least 8%, at least 9%, at least 10%, at least 11%, at least 12%, at least 13%, at least 14%, at least 15%, at least 16%, at least 17%, at least 18%, at least 19%, at least 20%, at least 21%, at least 22%, at least 23%, at least 24%, at least 25%, at least 26%, at least 27%, at least 28%, at least 29%, at least 30%, at least 31%, at least 32%, at least 33%, at least 34%, at least 35%, at least 36%, at least 37%, at least 38%, at least 39%, at least 40%, at least 45%, at least 50%, at least 55%, at least 60%, at least 65%, at least 70%, at least 75%, at least 80%, at least 85%, or at least 90% of the dispersant, based on a total weight of the active composition.

In an exemplary embodiment, the active composition includes no more than 99% of the dispersant, such as no more than 98%, no more than 97%, no more than 96%, no more than 95%, no more than 90%, no more than 85%, no more than 80%, no more than 75%, no more than 70%, no more than 65%, no more than 60%, no more than 55%, no more than 50%, no more than 45%, no more than 40%, no more than 39%, no more than 38%, no more than 37%, no more than 36%, no more than 35%, no more than 34%, no more than 33%, no more than 32%, no more than 31%, no more than 30%, no more than 29%, no more than 28%, no more than 27%, no more than 26%, no more than 25%, no more than 24%, no more than 23%, no more than 22%, no more than 21%, no more than 20%, no more than 19%, no more than 18%, no more than 17%, no more than 16%, no more than 15%, no more than 14%, no more than 13%, no more than 12%, no more than 11%, no more than 10%, no more than 9%, no more than 8%, no more than 7%, no more than 6%, no more than 5%, no more than 4%, no more than 3%, no more than 2%, or no more than 1%, based on a total weight of the active composition.

In various embodiments, the dispersant is present in the mixture in an active weight ratio (of dispersant to penetrant) of at least 1:99, at least 5:95, at least 10:90, at least 15:85, at least 20:80, at least 25:75, at least 30:70, at least 35:65, at least 40:60, at least 45:55, at least 50:50, at least 55:45, at least 60:40, at least 65:35, at least 70:30, at least 75:25, at least 80:20, at least 85:15, at least 90:10, or at least 95:5. In various non-limiting embodiments, all values and ranges of value, both whole and fractional, between and including the aforementioned values, are hereby expressly contemplated for use herein.

Penetrant:

The penetrant may be a strongly anionic surfactant. The anionic surfactant may be a hydrophobic chain comprised of an alkane, covalently bonded to an atom or group containing a formal negative charge. In certain embodiments, the strongly anionic surfactant is an anionic sulfonate surfactant. An exemplary anionic surfactant is a sodium sulfate or a sodium sulfonate surfactant. Exemplary sodium surfactants include, without limitation, sodium alkyl sulfates, sodium polyoxyethylene sulfates, sodium lauryl ether sulfates, sodium polyoxyethylene lauryl ether sulfates, sodium lauryl sulfates, sodium alkyl sulfonates, sodium alkyl ether sulfonates, sodium alkylbenzene sulfonates, sodium linear alkylbenzene sulfonates, sodium alpha-olefin sulfonates, sodium alcohol polyoxyethylene ether sulfonates, sodium dioctyl sulfosuccinates, and sodium dioctyl sulfosuccinates.

In certain embodiments, the anionic surfactant may be an alkylaryl sulfonate surfactant, alkyl sulfonate surfactant, alkyl ether sulfonate surfactant, alpha olefin sulfonate surfactant, paraffin sulfonate surfactant, or alkenyl sulfonate surfactant including, for example, sodium octadecylphenyl sulfonate, sodium xylene sulfonate, sodium (C14-C16)alpha olefin sulfonate, sodium tridecyl benzene sulfonate, and sodium dodecyl benzene sulfonate, or disodium alkyldiphenyloxide disulfonate. An exemplary anionic surfactant is sodium xylene sulfonate.

In certain embodiments, the treatment composition may include a single penetrant. In other embodiments, the penetrant may include a combination of more than one penetrant.

In an exemplary embodiment, the treatment composition includes at least 1% of the penetrant, such as at least 2%, at least 3%, at least 4%, at least 5%, at least 6%, at least 7%, at least 8%, at least 9%, at least 10%, at least 11%, at least 12%, at least 13%, at least 14%, at least 15%, at least 16%, at least 17%, at least 18%, at least 19%, at least 20%, at least 21%, at least 22%, at least 23%, at least 24%, at least 25%, at least 26%, at least 27%, at least 28%, at least 29%, at least 30%, at least 31%, at least 32%, at least 33%, at least 34%, at least 35%, at least 36%, at least 37%, at least 38%, at least 39%, at least 40%, at least 45%, at least 50%, at least 55%, at least 60%, at least 65%, at least 70%, at least 75%, at least 80%, at least 85%, or at least 90% of the penetrant, based on a total weight of the active composition.

In an exemplary embodiment, the treatment composition includes no more than 95% of the penetrant, such as no more than 98%, no more than 97%, no more than 96%, no more than 95%, no more than 90%, no more than 85%, no more than 80%, no more than 75%, no more than 70%, no more than 65%, no more than 60%, no more than 55%, no more than 50%, no more than 45%, no more than 40%, no more than 39%, no more than 38%, no more than 37%, no more than 36%, no more than 35%, no more than 34%, no more than 33%, no more than 32%, no more than 31%, no more than 30%, no more than 29%, no more than 28%, no more than 27%, no more than 26%, no more than 25%, no more than 24%, no more than 23%, no more than 22%, no more than 21%, no more than 20%, no more than 19%, no more than 18%, no more than 17%, no more than 16%, no more than 15%, no more than 14%, no more than 13%, no more than 12%, no more than 11%, no more than 10%, no more than 9%, no more than 8%, no more than 7%, no more than 6%, no more than 5%, no more than 4%, no more than 3%, no more than 2%, or no more than 1%. of the penetrant, based on a total weight of the active composition.

In various embodiments, the penetrant is present in the mixture in an active weight ratio (of penetrant to dispersant) of at least 1:99, at least 5:95, at least 10:90, at least 15:85, at least 20:80, at least 25:75, at least 30:70, at least 35:65, at least 40:60, at least 45:55, at least 50:50, at least 55:45, at least 60:40, at least 65:35, at least 70:30, at least 75:25, at least 80:20, at least 85:15, at least 90:10, or at least 95:5. In various non-limiting embodiments, all values and ranges of value, both whole and fractional, between and including the aforementioned values, are hereby expressly contemplated for use herein.

In other embodiments, the polymerized naphthalene sulfonate and the sodium xylene sulfonate are present in the mixture in an amount of from 0.1 to 99, weight percent actives based on a total weight of the mixture. In various embodiments, a combination of the polymerized naphthalene sulfonate and the sodium xylene sulfonate is present in an amount of from 0.1 to 10 kg actives/metric ton dry lignocellulosic material or from 0.5 to 2, 1 to 1.5, 0.5 to 1, 0.5 to 1.5, or 0.1, 0.2, 0.3 . . . 1, 2, 3 . . . . up to 10, kg actives/metric ton dry lignocellulosic material In various non-limiting embodiments, all values and ranges of value, both whole and fractional, between and including the aforementioned values, are hereby expressly contemplated for use herein.

White Liquor

In still other embodiments, the white liquor is present in an amount of from 0.1 to 99 weight percent based on a total weight of the mixture. In various embodiment, the white liquor is present in an amount of from 70 to 90, 75 to 85, or 75 to 80, weight percent actives based on a total weight of the mixture. In various non-limiting embodiments, all values and ranges of value, both whole and fractional, between and including the aforementioned values, are hereby expressly contemplated for use herein.

Mixture

Typically, the mixture is free of added surfactants that are not the dispersant, such a polymerized naphthalene sulfonate, and/or the penetrant, such as sodium xylene sulfonate. The terminology "added" surfactants differentiates those surfactants added to the pulping process and any surfactants produced in-situ via the pulping process such as tall oil soaps. Therefore, in various embodiments, the mixture is free of surfactants added thereto but may include in-situ created surfactants such as tall oil soaps and the like, as would be understood by those of skill in the art.

In various embodiments, the terminology "free of" describes that the mixture includes less than 10, 9, 8, 7, 6, 5, 4, 3, 2, 1, 0.5, or 0.1, weight percent actives of surfactants that are not the dispersant, such a polymerized naphthalene sulfonate, and/or the penetrant, such as sodium xylene sulfonate. Alternatively, the terminology "free of" may describe that the mixture includes zero weight percent actives of surfactants that are not the dispersant, such a polymerized naphthalene sulfonate, and/or the penetrant, such as sodium xylene sulfonate. In various non-limiting embodiments, all values and ranges of value, both whole and fractional, between and including the aforementioned values, are hereby expressly contemplated for use herein.

In various embodiments described throughout this disclosure, the terminology "consists essentially of" may describe one or more embodiments that are free of added surfactants that are not the dispersant, such a polymerized naphthalene sulfonate, and/or the penetrant, such as sodium xylene sulfonate, embodiments that are free of one or more additives not described herein and/or those described as optional herein, embodiments that are free of one or more types of pulp that are not described herein and/or are described as optional herein, embodiments that are free of one or more types of white and/or black and/or cooking liquors that are not described herein and/or that are described as optional herein, etc.

In various embodiments, the mixture described herein is, includes, consists essentially of, or consists of, the lignocellulosic material, the dispersant, the penetrant, the white liquor, and, optionally, a recycled aqueous stream from a pulping process.

In various embodiments, the mixture described herein is, includes, consists essentially of, or consists of, the lignocellulosic material, the polymerized naphthalene sulfonate, the sodium xylene sulfonate, the white liquor, and, optionally, a recycled aqueous stream from a pulping process.

In various embodiments, the instant disclosure, e.g. process, mixture, composition, etc., may be free of or include less than 10, 9, 8, 7, 6, 5, 4, 3, 2, 1, 0.5, or 0.1, weight percent actives of one or more of an additional anionic surfactant, derivatives thereof, salts thereof, or any combinations thereof. For example, such additional anionic surfactants may include, but are not limited to, a sulfonic acid, a sulfate, a carboxylate or carboxylic acid, a phosphate, a polyoxyalkylene glycol, polyalkylene glycol-polyalkylene glycol copolymer, or a derivative thereof, or a copolymer thereof, or a salt thereof, or any combination thereof. In other embodiments, the instant disclosure, e.g. process, mixture, composition, etc., may be free of or include less than 10, 9, 8, 7, 6, 5, 4, 3, 2, 1, 0.5, or 0.1, weight percent actives of one or more of unrefined fatty acids include, but are not limited to, coconut oil, cochin oil, corn oil, cottonseed oil, linseed oil, olive oil, palm oil, palm kernel oil, peanut oil, soybean oil, sunflower oil, tall oils, tallow, *lesquerella* oil, tung oil, whale oil, tea seed oil, sesame seed oil, safflower oil, rapeseed oil, fish oils, avocado oil, mustard oil, rice bran oil, almond oil, walnut oil, derivatives thereof, and combinations thereof.

In various embodiments, the instant disclosure, e.g. process, mixture, composition, etc., may include, may be free of, or may include less than 10, 9, 8, 7, 6, 5, 4, 3, 2, 1, 0.5, or 0.1, weight percent actives of one or more of a carrier, e.g. which may be employed for transporting or delivering any component described herein. Typically, this disclosure involves water pulping and not solvent pulping. For example, the carrier may be water, an organic solvent, an alcohol, etc. In various embodiments, a carrier is utilized in an amount of 20 wt. % or more, such as 30 wt. % or more, such as 40 wt. % or more, such as 50 wt. % or more, such as 60 wt. % or more, such as 70 wt. % or more, such as 80 wt,% or more to less than 100 wt. %, such as 99 wt. % or less, such as 95 wt. % or less, such as 90 wt. % or less, such as 80 wt. % or less, based on the weight of the mixture.

In various embodiments, the process of this disclosure exhibits an increased digestion efficiency as compared to a process that does not utilize a combination of the dispersant, such a polymerized naphthalene sulfonate, and the penetrant, such as sodium xylene sulfonate. This increased digestion efficiency may be expressed in various ways.

For example, and as first introduced above, it is well known that in various types of pulping processes lignocellulosic materials are blown from the treatment vessel into a blow tank and then broken down into separate wood fibers. In practice, however, some of the lignocellulosic materials fail to completely separate due, in part, to the undissolved lignin. These unseparated materials are removed by passing through a screen having openings of a predetermined size. In the pulping industry, the standard test screen employed is flat with 0.01 inch slots therethrough. The materials recovered by this screening process are known as "rejects". The rejects include fibers that could be used to for the desired outcome. Accordingly, it is highly desirable to decrease the amount of rejects. One method of lowering the amount of rejects is by increasing the digestion time or by creating more severe hydrolysis conditions. Such conditions, however, increase the costs involved and cause some of the cellulose in the wood chips to be hydrolyzed and rendered unusable. Therefore, the process of the instant disclosure surprisingly, unexpectedly, and with superior efficiency, can reduce the amount of rejects, as described above, without increasing the digestion time or by creating more severe hydrolysis conditions, thereby indicating increased digestion efficiency. In various embodiments, the percent rejects are less than 30, 25, 20, 15, 10, 9, 8, 7, 6, 5, 4, 3, 2, 1, or 0.5, weight percent, based on a total original weight percent of the lignocellulosic materials added to the treatment vessel. In various non-limiting embodiments, all values and ranges of value, both whole and fractional, between and including the aforementioned values, are hereby expressly contemplated for use herein.

In other embodiments, the instant process may provide an improvement in the pulp yield by 0.01% to 5% calculated based on weight of useable fiber derived from the process/weight of the oven dried wood at the start. In various non-limiting embodiments, all values and ranges of value, both whole and fractional, between and including the aforementioned values, are hereby expressly contemplated for use herein.

In other embodiments, the instant process may provide a reduction in the amount of white liquor required. For instance, the white liquor required may be reduced by 0.1% or more, such as 0.5% or more, such as 1% or more, such as 1.5% or more, such as 2% or more, such as 2.5% or more, such as 3% or more, such as 3.5% or more, such as 5% or more to 15% or less, such as 10% or less, such as 7% or less, such as 5% or less, such as 4% or less, such as 3% or less. In various non-limiting embodiments, all values and ranges of value, both whole and fractional, between and including the aforementioned values, are hereby expressly contemplated for use herein.

In still other embodiments, the instant process provides a reduction in kappa number, which is indicative of the amount of residual lignin on the fibers. Typically, the kappa number is determined using TAPPI STANDARD T236 (Kappa Number of Pulp). In various non-limiting embodiments, all values and ranges of value, both whole and fractional, between and including the aforementioned values, are hereby expressly contemplated for use herein.

In other embodiments, the instant process provides an increase in residual active alkali, also known as RA. Typically, the RA is determined using SCAN-N 33:94. In various embodiments, the RA is from 5 to 20, such as at least 5, at least 6, at least 7, at least 8, at least 9, at least 10, at least 11, or at least 12, g/L. In various non-limiting embodiments, all values and ranges of value, both whole and fractional, between and including the aforementioned values, are hereby expressly contemplated for use herein.

In still other embodiments, it is observed that a synergistic mixture affords a pulp with a lower reject count and a lower lignin content (corresponding to ~ kappa number units) with increased yield.

EXAMPLES

Hardwood and/or softwood wood chips were added into a circulating laboratory digester (M/K Systems) along with white liquor in a ratio of 1:4.5.

In a Control sample, no active composition treatment was added. In other words, no dispersant, such as polymerized naphthalene sulfonate, and no penetrant, such as sodium xylene sulfonate, were added. This is indicated herein as No Treatment (NT).

In a Comparative Sample A, a dispersant, i.e., polymerized naphthalene sulfonate, was added but no penetrant was added.

In a Comparative Sample B, a penetrant, i.e., sodium xylene sulfonate, was added but no dispersant was added.

In an Inventive Sample, both a dispersant, in the form of polymerized naphthalene sulfonate, and a penetrant, in the form of sodium xylene sulfonate, were added. The dispersant and penetrant were provided in 50:50 ratio by weight. This indicated below as Mixture 1.

After forming the samples described above, the digester was sealed, and the mixture was heated to attain a certain H-Factor. H-Factor is a single numerical value for expressing the 2 combined values of digester time and pulping temperature. All comparable tests were conducted using the same H-Factor, i.e. (GD H=165) depending by the Wood chips type used. The Wood chips were deliberately undercooked using the same H-Factor. This was to help in determining the discernible differences after each digestion, especially in the quantity of rejects screened out during this pulping process (% Rejects), Kappa numbers indicative of the amount of lignin remaining in lignocellulosic material after treatment, and residual alkali indicative of the efficiency of the de-lignification process.

Figure 2:
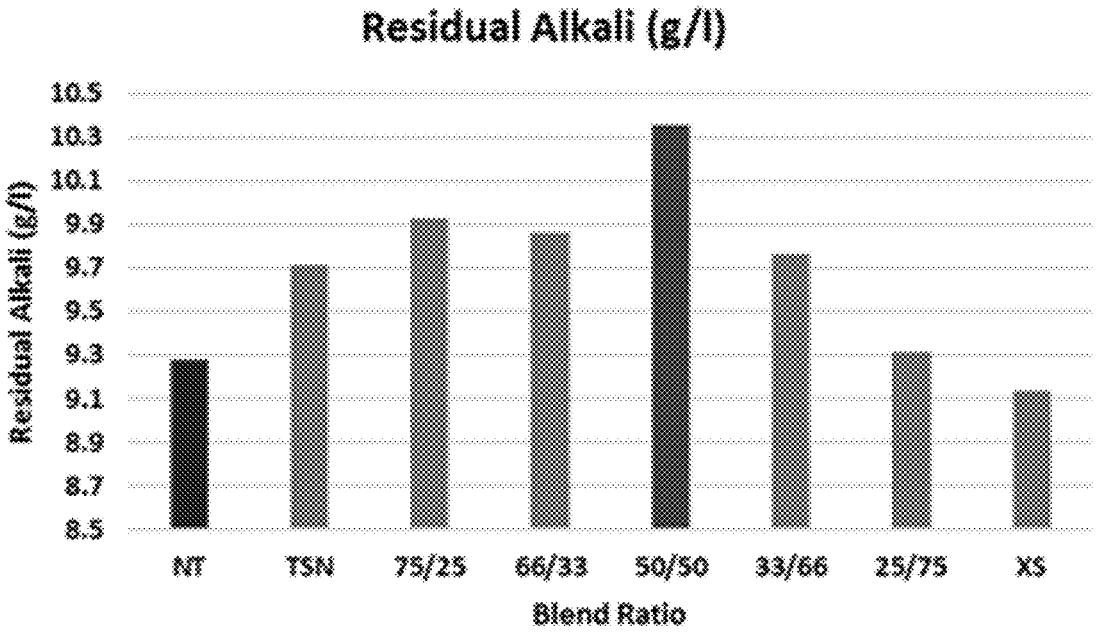
FIG. 2 is a bar-graph showing the residual alkali present in black liquor after treatment of lignocellulosic material according to exemplary methods herein and according to comparative methods.
Figure 3:
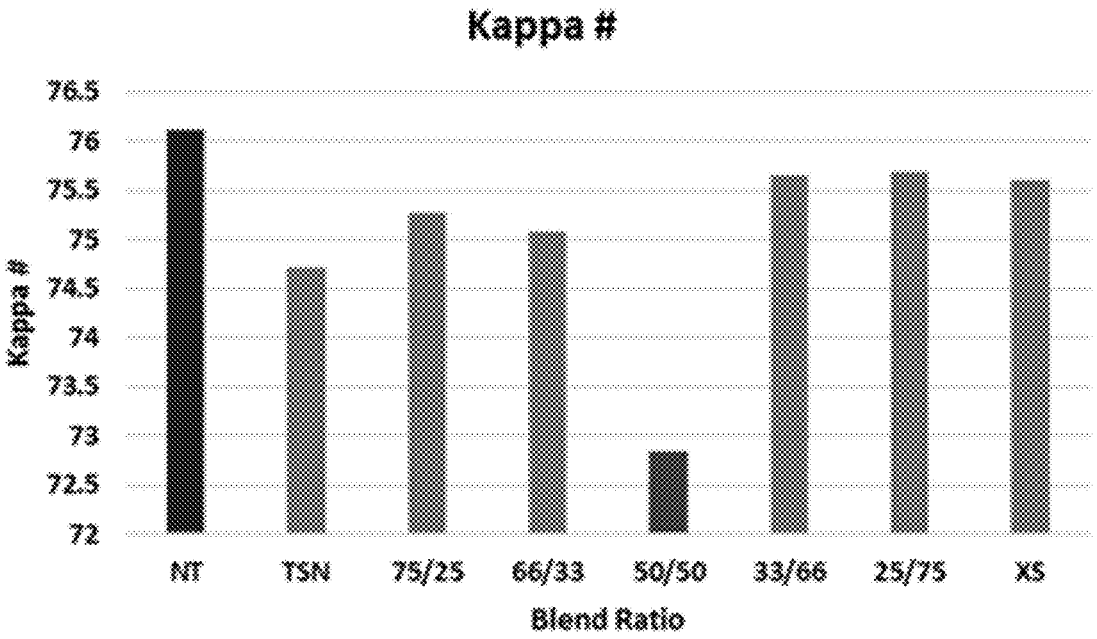
FIG. 3 is a bar-graph showing the Kappa number, a measurement of the amount of lignin remaining in lignocellulosic material after treatment according to exemplary methods herein and according to comparative methods.

The test results are set forth in Table 1 that follows and shown in FIGS. 1-3:

TABLE 1

| Example | Active Composition | % Rejects | Kappa No. | Residual Alkali (g/L) |
|---|---|---|---|---|
| Control | No Treatment (NT) (Avg) | 9.69 | 76.11 | 9.275 |
| Comp A | Polymerized naphthalene sulfonate | 8.69 | 74.72 | 9.712 |
| Comp B | Sodium xylene sulfonate | 9.16 | 75.61 | 9.133 |
| Mixture 1 | Mixture of Polymerized naphthalene sulfonate:Sodium xylene | 8.14 | 72.85 | 10.354 |

TABLE 1-continued

| Example | Active Composition | % Rejects | Kappa No. | Residual Alkali (g/L) |
|---|---|---|---|---|
| | sulfonate (50:50 by weight) | | | |

In the above, the lignocellulosic material is pine wood chips.

The weight percent of the lignocellulosic material, expressed as dry lignocellulosic material, is 1 part out of 5.5 total parts of the mixture.

The total weight of the actives of the polymerized naphthalene sulfonate and the sodium xylene sulfonate is 0.1% weight percent based on a total weight of the dry lignocellulosic material.

The white liquor is 1.29 wt % $Na_2S$ and 3.98 wt % NaOH in water and is present in the mixture in an amount of 81.82% weight percent based on a total weight of the mixture.

The Control Example, which included no added active composition, has a high % rejects; a high Kappa number, indicating the presence of a substantial amount of undissolved lignin, and a low amount of residual alkali, indicating an inefficient de-lignification process.

Comparative Example A, including only a dispersant in the added active composition, has decreased % rejects, a decreased Kappa number, and a higher amount of residual alkali.

Comparative Example B, including only a penetrant in the added active composition, has more moderately decreased % rejects, a more moderately decreased Kappa number, and a lowest amount of residual alkali.

Mixture 1 provides the lowest % rejects, the lowest Kappa number, and the highest amount of residual alkali. Mixture 1 also demonstrates a superior and unexpected synergistic effect as compared to embodiments in which a dispersant or a penetrant were used alone.

The data generated in the aforementioned tests shows that the mixture of the polymerized naphthalene sulfonate and the sodium xylene sulfonate is a superior digester additive as compared to either the polymerized naphthalene sulfonate or the sodium xylene sulfonate on its own.

These results were unanticipated and represent a beneficial synergistic effect afforded a pulp with a lower reject count and a lower lignin content (corresponding to lower kappa number units). Residual alkali was improved as well. This represents a significant improvement in delignification efficacy.

FIG. 1 illustrates the % rejects for the Control Example (NT), Comparative Example A (TSN), Comparative Example B (XS), and Mixture 1 (50:50) at a 50:50 dispersant:penetrant blend ratio (by weight), as well as a Mixture 2 (75:25) in which the added active composition has a dispersant:penetrant blend ratio of 75:25 (by weight), and a Mixture 3 (66:33) in which the added active composition has a dispersant:penetrant blend ratio of 66:33 (by weight). As shown, each of Mixtures 1-3 outperforms the Control and the Comparative Examples, with the 50:50 blend ratio performing the best.

FIG. 2 illustrates the residual alkali for the Control Example (NT), Comparative Example A (TSN), Comparative Example B (XS), Mixture 1 (50:50), Mixture 2 (75:25), and Mixture 3 (66:33). As shown, each of Mixtures 1-3 outperforms the Control and the Comparative Examples, with the 50:50 blend ratio performing the best.

FIG. 3 illustrates the Kappa numbers for the Control Example (NT), Comparative Example A (TSN), Comparative Example B (XS), Mixture 1 (50:50), Mixture 2 (75:25), and Mixture 3 (66:33). As shown, each of Mixtures 1-3 outperforms the Control and the Comparative Examples, with the 50:50 blend ratio performing the best.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment. It being understood that various changes may be made in the function and arrangement of elements described in an exemplary embodiment without departing from the scope as set forth in the appended claims.

What is claimed is:

1. A method for digesting lignocellulosic material, the method comprising:

combining a lignocellulosic material comprising lignocellulosic biomass, a polymerized naphthalene sulfonate, a sodium xylene sulfonate, and a white liquor comprising sodium hydroxide and sodium sulfide to form a mixture, wherein the polymerized naphthalene sulfonate is a beta-naphthalene sulfonate formaldehyde condensation product; and heating the mixture to digest at least a portion of the lignocellulosic material.

2. The method of claim 1, wherein a combination of the polymerized naphthalene sulfonate and the sodium xylene sulfonate is present in an amount of from 0.1 to 10 kg per metric ton of dry lignocellulosic material.

3. The method of claim 1, wherein the white liquor, excluding any recycled black liquor or wood moisture, is present in an amount of from 70 to 90 weight percent based on a total weight of the mixture, wherein the total weight of the mixture includes the weight of the dry lignocellulosic material.

4. The method of claim 1, wherein the mixture is free of added surfactants that are not the polymerized naphthalene sulfonate and/or the sodium xylene sulfonate.

5. The method of claim 1, wherein the mixture consists essentially of the lignocellulosic material, the polymerized naphthalene sulfonate, the sodium xylene sulfonate, the white liquor, and a recycled aqueous stream from a pulping process.

6. The method of claim 1, wherein the polymerized naphthalene sulfonate is a sodium salt of a formaldehyde-naphthalene sulfonate condensation polymer.

7. The method of claim 1, wherein the polymerized naphthalene sulfonate is free of alkyl substituents.

8. The method of claim 1, wherein the white liquor consists of an aqueous solution containing from 1.0 to 1.5 weight percent sodium sulfide, from 3.5 to 4.5 weight percent sodium hydroxide, and the balance water.

9. The method of claim 1, wherein a combination of the polymerized naphthalene sulfonate and the sodium xylene sulfonate is present in an amount of from 0.1 to 0.5 kg per metric ton of dry lignocellulosic material.

10. The method of claim 1, wherein the lignocellulosic material is present in an amount of from 10 to 30 weight percent based on a total weight of the mixture.

11. The method of claim 1, wherein the lignocellulosic material comprises pine wood chips.

12. A method for digesting lignocellulosic material, the method comprising:

combining a lignocellulosic material comprising lignocellulosic biomass, a dispersant, a penetrant, and a white liquor comprising sodium hydroxide and sodium sulfide to form a mixture; and heating the mixture to digest at least a portion of the lignocellulosic material, wherein the mixture has a dispersant to penetrant ratio of from 10:90 to 90:10, the mixture has a combined total content of the dispersant and the penetrant of from 0.1 to 10 kg per metric ton of dry lignocellulosic material, and the white liquor, excluding any recycled black liquor or wood moisture, is present in an amount of from 70 to 90 weight percent based on a total weight of the mixture.

13. The method of claim 12, wherein the mixture has a dispersant to penetrant ratio of from 40:60 to 60:40.

14. The method of claim 12, wherein the dispersant comprises polymerized naphthalene sulfonate and the penetrant comprises sodium xylene sulfonate.

15. The method of claim 12, wherein the dispersant consists of polymerized naphthalene sulfonate and the penetrant consists of sodium xylene sulfonate.

16. The method of claim 12, wherein:

the lignocellulosic material consists of pine wood chips having a moisture content of less than 50% by weight;

the dispersant consists of polymerized naphthalene sulfonate having a molecular weight of from 6,000 to 8,000 g/mole;

the penetrant consists of sodium xylene sulfonate;

the white liquor consists of an aqueous solution containing from 1.0 to 1.5 weight percent sodium sulfide, from 3.5 to 4.5 weight percent sodium hydroxide, and the balance water;

the dispersant to penetrant ratio is 50:50 by weight; and the combined total content of the dispersant and the penetrant is 1 kg per metric ton of dry lignocellulosic material.

17. The method of claim 12, wherein the dispersant consists of polymerized naphthalene sulfonate and the penetrant consists of sodium xylene sulfonate, and wherein the mixture is free of added surfactants that are not the dispersant and/or the penetrant.

18. The method of claim 12, wherein the white liquor consists of an aqueous solution containing from 1.0 to 1.5 weight percent sodium sulfide, from 3.5 to 4.5 weight percent sodium hydroxide, and the balance water.

19. The method of claim 12, wherein the lignocellulosic material is present in an amount of from 10 to 30 weight percent based on a total weight of the mixture.

20. A method for digesting lignocellulosic material, the method comprising:

combining a lignocellulosic material comprising lignocellulosic biomass, a polymerized naphthalene sulfonate, a sodium xylene sulfonate, and a white liquor comprising sodium hydroxide and sodium sulfide to form a mixture; and heating the mixture to digest at least a portion of the lignocellulosic material, wherein the polymerized naphthalene sulfonate has a molecular weight of from 6,000 to 8,000 g/mole.

* * * * *